United States Patent [19]
Gau

[11] Patent Number: 4,478,668
[45] Date of Patent: Oct. 23, 1984

[54] LABELING MACHINE

[75] Inventor: George Gau, Obertraubling, Fed. Rep. of Germany

[73] Assignee: Krones AG Hermann Kronseder Maschinenfabrik, Neutraubling, Fed. Rep. of Germany

[21] Appl. No.: 572,308

[22] Filed: Jan. 20, 1984

[30] Foreign Application Priority Data

Jan. 22, 1984 [DE] Fed. Rep. of Germany ..... 3302031

[51] Int. Cl.³ ..... B65C 9/16; B65C 9/42

[52] U.S. Cl. ..... 156/364; 118/231; 156/568; 156/571; 156/DIG. 32; 156/DIG. 45; 271/33

[58] Field of Search ..... 156/364, 567, 568, 571, 156/DIG. 29, DIG. 32, DIG. 45; 271/33, 258; 118/220, 231

[56] References Cited

U.S. PATENT DOCUMENTS 4,279,687 7/1981 Buchholz et al. ..... 156/571
4,361,460 11/1982 Kronseder ..... 156/571
4,445,961 5/1984 Kronseder et al. ..... 156/364

*Primary Examiner*—Michael Wityshyn
*Attorney, Agent, or Firm*—Fuller, House & Hohenfeldt

[57] ABSTRACT

A labeling machine has a rotor on which several oscillatingly driven pallet shafts are supported. Each shaft has a carriage shiftable transversely to the shaft axis. Glue pallets having partly cylindrical surfaces for being coated with glue are mounted to the carriage and are thereby movable from a radially outward position to a radially inward or neutral position for, respectively, contacting a glue roller and a label in a stack successively and for being retracted to neutral position out of the path of the roller and stack. The shafts have an enlarged central section which is rectangular in cross section and a complementarily shaped channel on a sleeve that carries the curved pallets is supported for sliding transversely to the pallet shaft axis. The sleeve is shifted by means of compressed air acting on a piston located in the enlarged portion of the shaft and is held tight in either active position or neutral position by applying compressed air constantly to one side of the piston while the other side is exhausting.

8 Claims, 3 Drawing Figures

LABELING MACHINE

BACKGROUND OF THE INVENTION

This invention relates to a machine for applying labels to bottles, containers and other objects.

The invention pertains to an automatic labeling machine of the type in which several pallets are arranged on a rotor. The rotor is rotated to bring the pallets successively in contact with a glue roller. The glue coated pallets are then placed in contact with a source of labels and the labels are next applied to a transfer cylinder that presses them onto the moving containers.

A problem that arises in the labeling field is to momentarily interrupt picking up and delivery of labels when there is a gap in the series of containers being conveyed so no container will be present for labeling at the label application station. First, label pickup must start or stop in synchronization with the supply of bottles, for example, that are to be labeled. Secondly, when short gaps appear in the bottle feed line, even a gap of just one bottle, pickup of labels and glue must be stopped to avoid fouling the labeling machine with superfluous labels. One solution to the problem can be found in U.S. Pat. No. 4,361,460. In this patent, as in the machine disclosed herein, the pallets are mounted on individual shafts and the shafts are oscillated as they orbit around on the rotor as they successively perform their glue coating, label pickup and transfer operations. Each shaft is mechanically coupled to an air cylinder which, in one state, lets the pallet shaft be driven oscillattingly and when in another state locks the pallet shaft and, hence, the pallet in an angular position wherein it cannot come in contact with the glue applicator roller nor the label at its source. When a gap in the bottle feed line is detected, a device is set such that as the actuating cylinders for the pallet shafts pass it, the cylinders respond by locking the passing pallet at a rotational angle wherein the pallet cannot make the contact just mentioned. As the pallets pass the point of label application, they are reset in active positon. Labeling machines of this type are capable of applying approximately 60,000 labels per hour. A disadvantage, however, is that the shifting couplings are actuated or locked in inactive position and reset to active position for every revolution of the rotor which is disadvantageous if the gap in the bottle line is a long one since the constant recycling results in increased wear on the parts that are involved in locking the pallets against rotation and resetting them to active position. Moreover, the locking operation takes place usually at a single point along the orbital path of the pallets which has been considered necessary to avoid upsetting synchronization of the pallet oscillations with their orbital positions.

SUMMARY OF THE INVENTION

The objective of the present invention is to provide for establishing the pallets in a position wherein they cannot contact the glue roller nor the label source regardless of where a pallet is in its orbital path at the time a gap in the botttle line is detected.

In accordance with the invention, the normal oscillating movement of the glue pallets is not interrupted at any time. Instead, the pallets are retracted radially inwardly of the rotor from an active position to a neutral position in response to a gap being detected so as to become clear of the glue roller, the label stack and the gripper cylinder that effects transfer of the labels.

An advantage of the invention is that it becomes possible to shift the pallets into neutral position such as between the glue roller and the stack of labels or between the stack and the gripper or transfer cylinder and to maintain them in neutral position, without stopping their oscillations until bottles are restored to the label transfer station.

Moreover, a relatively long time is available for shifting the pallets between neutral and active positions over the entire angle of revolution or orbiting between the transfer cylinder and the glue roller. In addition, the new labeling machine reduces the frequency at which the pallet shafts are shifted and, thus, minimum wear of the parts is a benefit since shifting is only done when a gap in the series of containers begins and ends and not during every rotor revolution while the gap lasts.

A further feature of the invention is that the pallet operating or active position and the neutral position are positively defined by stops or guides. This can be done, for example, by means of special locking or snapping elements. Thus, in accordance with the invention, the pallet shifting or actuating means do the fixing of the glue pallets in their end positions and, therefore, render special locking means or the like unnecessary.

Another important feature of the invention is that the glue pallets have to be shifted to neutral position substantially radially inwardly toward the rotor axis by a small amount such as, in the average size machine, about 10 mm. on the rotor or pallet carriage in order to permit the curved pallet surfaces to orbit without contacting the labels or the glue roller. In accordance with the invention, the most effective point on which to apply the shifting force is at about in line with the midpoint of the curved pallet surfaces during transition into neutral position. In machines that are designed for applying labels to large cylindrical containers or bottles, the curved, partially cylindrical pallet surfaces have considerable circumferential length. In extreme cases, the curved pallet surfaces may subtend an angle of 180°. Even in such cases, the ends of the curved pallet surfaces on which the glue is applied can move away from the axis of rotation of the rotor sufficiently. Yet, contacting the stack of labels is prevented since the end areas of the curved pallet surfaces might enter the plane of label removal only when orbited far away from the stack of labels. As a pallet continues in its orbit past the label pickup station, the curved glue coating surface of the pallet moves farther and farther from the plane of label removal. According to a further feature of the invention, for one array of glue pallets only one actuating member is required. Another feature is that volume and weight of the pallet actuating parts can be reduced. Another feature is that all of the pallets are actuated with their own control valves rotating with the rotor and only one valve operator at a fixed location is needed for all of the valves.

The manner in which the foregoing objectives and features and other more specific objectives and features are achieved will be evident in the more detailed description of a preferred embodiment of the invention which will now be set forth in reference to the drawings.

DESCRIPTION OF A PREFERRED EMBODIMENT

Figure 1:
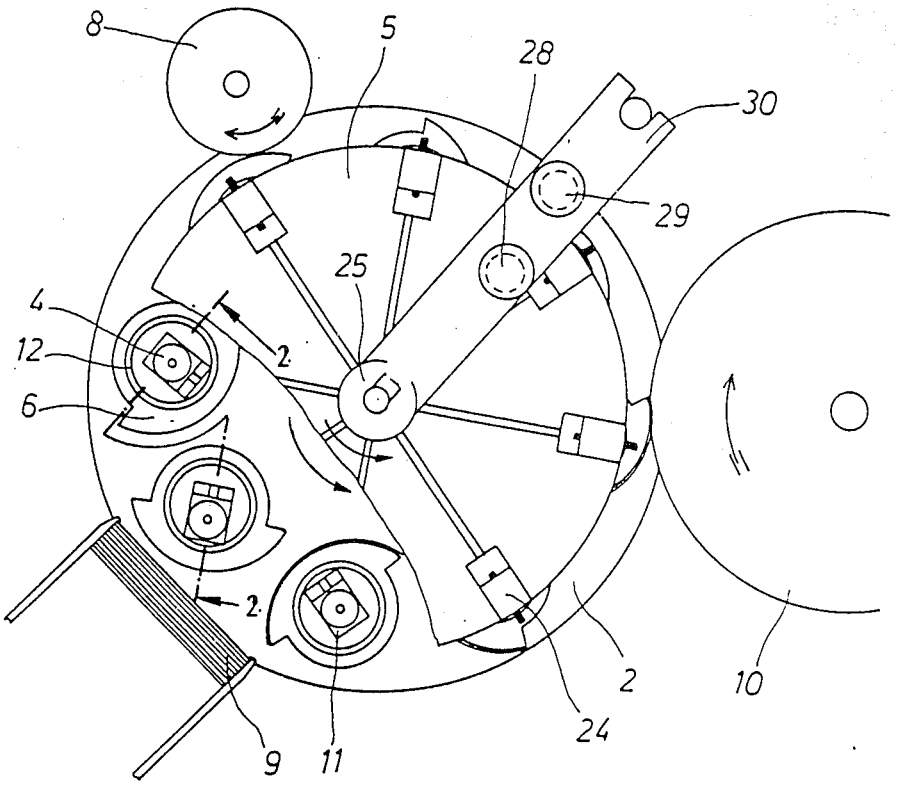
FIG. 1 is a simplified plan view of the labeling machine with its cover removed.

Referring to the drawings, the labeling machine comprises a stationery housing 1 in which a drum shaped rotor 2 is supported for rotation about a vertical axis. Evenly distributed in a circle on rotor 2 are, in this particular machine, eight bushings or couplings 3 having a polygonal bore 3*a*. The bushings 3 are driven oscillatingly about vertical axis by means of a suitable drive mechanism, not shown, located within housing 1. The oscillating drive mechanism may be similar to that which is described in U.S. Pat. No. 4,361,460 wherein there is a stationery cam groove and cam followers running in the groove which are connected to the equivalent of bushings 3 in FIG. 2 of this application by suitable oscillating links, none of which are shown in the drawings of this application. For present purposes, it is only necessary to be aware that the bushings 3 oscillate about a vertical axis through a limited angle and not through a whole revolution as the bushings 3 orbit with rotor 2. A center shaft about whose axis the rotor rotates is marked 32 in FIG. 2 of the drawing and is at the center of the rotor 2 but is obscured in FIG. 1.

In each bushing 3 there is a pallet shaft 4 that has integral with its lower end a polygonally shaped portion 4*a* that is complementary to the bore of socket 3*a* in bushings 3. It will be evident that the complementarily shaped shaft part 4*a* and bore 3*a* result in a driving connection or slideable coupling between bushings 3 and pallet shafts 4 so that the pallet shafts oscillate about their vertical axes cyclically with the oscillatingly driven bushings 3. The upper end 4*b* of shaft 4 is journaled in a plate 5 which is fastened releasably on center shaft 32 and rotates with rotor 2. The pallet shafts 4 may be easily removed from bushings 3 by simply removing plate 5.

Figure 3:
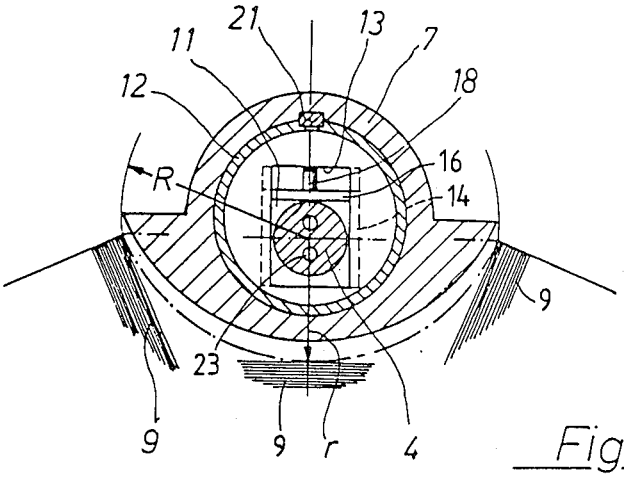
FIG. 3 is a transverse section taken on a line corresponding to 3—3 in FIG. 2.

There are two curved glue pallets 6 and 7 mounted to the pallet shaft assembly. One pallet 6 may pick up a label with its glue coated periphery for applying it to the lower portion of a container such as a bottle and the upper pallet 7 may pick up a label for having it applied higher up on the containers that are successively passing a label application station on a conveyor, not shown. As can be seen in FIG. 3, the curved pallet surfaces are eccentric to pallet shafts 4. In FIG. 1, the pallets 6 and 7 are shown at the various angles to which they are oscillated as they orbit around rotor 2. As shown in FIG. 1, the rotor rotates in the direction indicated by the arrow and the curved glue pallet surfaces 6 roll successively on the periphery of a glue applicator roller 8 and then orbit around to pick up a label 9 which, in turn, receives glue from the pallet. The pallet carries the label around to a transfer cylinder 10 on which there are well known devices, called grippers, not shown, which remove the labels from the pallets. The gripper or transfer cylinder 10, in the course of its rotation, presses the glue coated label against a bottle, not shown, which is passing cylinder 10 in a line of bottles that are transported on a conveyor, not shown, in a well known fashion.

Each of the pallet shafts 4 is formed in one piece and has approximately at its center an enlarged section 11 that has a rectangular cross section. A sleeve 12 comprises a pallet carriage means and is fitted on enlarged and rectangular section 11 of pallet shaft 4. Sleeve 12 is provided with an axially extending slot 13 which engages with the opposite side surfaces of the enlarged section with the least possible play and in slideable relationship. The enlarged section 11 and slot 13 form a straight guide for the sleeve 12. There are a pair of projections 14 in the end areas of slot 13 which abut on the oppositely disposed front sides of the enlarged shaft section 11 to fix the carriage sleeve against shifting axially of the pallet shaft 4 and to guide it for shifting transversely to the axis of shaft 4. There is a hollow air pressurizable cylinder 15 formed in the interior of the enlarged section 11 of each shaft and the axis of this cylindrical chamber is parallel to the line of transverse movement of carriage sleeve 12. Thus cylinder 13 is closed on one side by the wall of the enlarged section 11 and on the other side by means of a cover plate 16 that is held onto shaft 4, that is to the enlarged section 11 thereof, by means of screws in a leak-proof manner. There is a diametrally slideable piston 17 within cylinder 15 comprising a carriage drive member and the piston has a piston rod 18 extending from both sides. Thus, the piston rod 18 passes through a hole in cover plate 16 that contains an o-ring seal so air cannot leak around rod 18. The other end of rod 18 extends into an o-ring containing hole in the wall of enlarged section 11. The piston rod 18 is almost as long as the width of slot 13 and abuts or engages with both of its ends on the carriage sleeve 12. The cylinder 15 and the piston 17 and the piston rod 18 form the actuating or drive member for carriage sleeve 12 by means of which the sleeve may be pushed transversely relative to the axis of pallet shaft 4 and held tight in both end positions, that is, in a radially extended position and in a retracted position. These end positions of the sleeve 12 with respect to pallet shaft 4 are exactly defined by means of the surfaces of the slot 13 acting as a stop member on which the piston rod 18 engages in cooperation with cylinder cover 18 and the oppositely disposed side surface of the enlarged shaft section 13. In one end position, that is, in retracted or neutral position, sleeve 12 lies exactly concentrically to the pallet shaft 4 and in the other end position or extended or active position, it lies approximately 10 mm. eccentrically to the pallet shaft in one embodiment.

Figure 2:
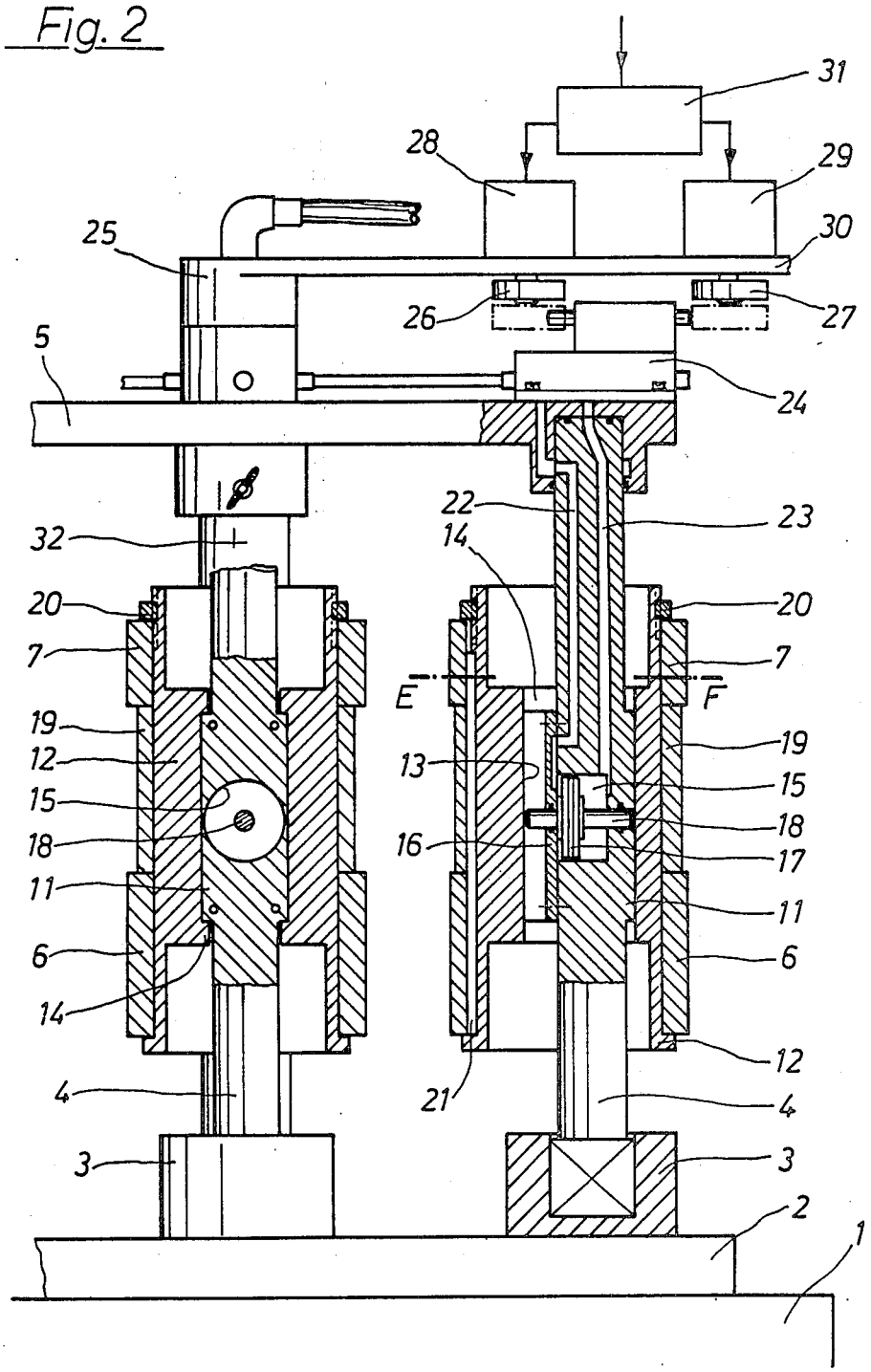
FIG. 2 shows a vertical section through two of the pallet assemblies taken on the irregular line corresponding to 2—2 in FIG. 1.

The glue pallets 6 and 7 are provided with a bore as can be seen particularly well in FIG. 3 so that they can be fitted on a cylindrical part of carriage sleeve 12. The pallets 6 and 7 are held in spaced apart relationship with spacer rings 19. As can be seen in FIG. 2 particularly well, the lower end of pallet 6 stops against a shoulder on sleeve 12 and the upper end of pallet 7 receives a compressive force from an internally threaded clamping nut 20 that is turned on a corresponding thread in the periphery of sleeve 12. In addition, the pallets, as demonstrated with pallet 7 in FIG. 3, are secured against rotation relative to sleeve 12 by means of a key 21 which assures that the sleeve 12 and, hence, the curved pallets 6 and 7, will rotate or oscillate correspondingly with pallet shaft 4. The glue pallets 6 and 7 are most radially outward with respect to the axis of shaft 4 in their normal or active operating position when sleeve 12 lies concentrically to shaft 4. In this operating or end position, the curved oscillating glue bearing surfaces of the pallets 6 and 7 roll down in constant tangency on glue roller 8 and on the exposed label in the stack of labels 9 for transferring the labels thus removed to the label gripper cylinder 10. On the other hand, if the carriage sleeve 12 is shifted to its other end position eccentric to pallet shaft 4, the pallets 6 and 7 are in a neutral position wherein the curved glue bearing surfaces of the pallets 6 and 7 are closer to the axis of rotation or oscillation of the pallet shaft 4. When the pallets 6 and 7 are retracted to neutral position their curved surfaces cannot contact glue roller 8 nor a label in stack 9 but they are allowed to continue to oscillate as they orbit around on rotor 2. In order to minimize the required radial movement of the glue pallets, the piston rod 18 applies the shifting force to carriage sleeve 13 and to the pallets parallel to the shortest line between the glue bearing surfaces of the pallets and the axis of rotation of pallet shaft 4; that is, in the present case, parallel to the plane of symmetry of the glue pallets 6 and 7. Thus, upon transfer into the neutral position as indicated by the solid line representation of the pallet in FIG. 3, neither the central area nor the end areas of the curved glue pallet surface can come in contact with the top label 9 in a stack regardless of where it is positioned. If the glue bearing curved surfaces of the pallets are longer than in the FIG. 3 case, possible covering an angle of over 180°, upon transition from the operating position into the neutral position, the lateral ends of the curved glue bearing surfaces are still removed slightly from the axis of rotation of shaft 4. Nevertheless, no contact takes place with the stack of labels or the glue roller, as the rolling movement of the end areas commences even before the normal rolling movement or after the latter ends, respectively. Also to be noted is that the central areas of the glue bearing curved surfaces of the pallets 6 and 7 move susbstantially perpendiucular to the axis of rotation of the pallet shaft. In FIG. 3, the dashed-dot line indicates where the curved surface of the glue pallet reaches when the pallets are shifted to active position wherein they can contact glue roller 8 and labels 9.

Two air conducting channels 22 and 23 lead to the opposite sides of piston 17 in cylinder 15. Cover plate 16 is grooved to form the lower end of channel 22. The top ends of channels 22 and 23 run out of shaft 4 and through plate 5 which rotates with the rotor 2. There is a control valve 24 mounted to plate 5. Each control valve 24 is supplied with compressed air from a rotatable compressed air distributor or header 25 which is connected to a compressed air source, not shown, by means of a tube 40. Control valve 24 is operative to always keep one side of piston 17 under pressure while the chamber 15 on the other side of the piston is evacuated. Control valve 24 is actuated by valve operator means comprising two stationery rollers 26 and 27. Control valve 24 orbits with rotor 2 and its top plate 5. Rollers 26 and 27 do not orbit. They are, however, shiftable selectively up and down as indicated in phantom in FIG. 2. The rollers are shiftable down and up by means of fast-acting compressed air cylinders 28 and 29 which are fixed to a stationery arm 30. Rollers 26 and 27 are shiftable into and out of the path of the plunger 41 for a slide valve controller 42. Air cylinders 28 and 29 are supplied with compressed air through tubes 43 and 44 which lead from a control device 31. The control device has a compressed air inlet pipe 45 and an exhaust pipe 46. The control 31 is basically an electrically operated device which is under the control of a bottle gap sensor that is represented by the block marked 47. Both fast-acting compressed air cylinders 28 and 29 are located along the orbital path of the rotor 2 between the gripper or transfer cylinder 10 and the glue roller 8 as can be seen in FIG. 1. The bottle gap sensor can comprise a label feeler or a bottle feeler or a photosensory system near the input stage for the bottles so that if one or more bottles is missing to thereby create a gap in the series of bottles being conveyed for labeling, this condition will be sensed and an operating signal will be supplied to control 31 which will ultimately bring about inward retraction of pallets 6 and 7 to a neutral position. Consequently, when there is a gap in the bottle supply or, for example, when there is an entry of a bottle that is already labeled, so that the glue pallets 6 and 7 should remove no labels from the stacks 9, the outer roller 27 shortly before encountering the control valve 24 slider 41, moves downward into the path of rotation as indicated by the phantom lines and presses the slider radially inwardly and then the roller 27 is immediately withdrawn from the path of rotation so the slider stays where it is as long as the gap persists. Control valve 24 at this time supplies compressed air to one side of the piston 16 so that the pallet carrying carriage sleeve 12 shifts transversely to the enlarged section 11 of the pallet shaft 4 to thereby retract the pallets 6 and 7 to neutral position out of the path of the glue roller 8 and the labels 9. This retracted or neutral position of the carriage is positively maintained by air pressure on the piston as long as the gap persists. Nevertheless, the shafts 4 and pallets 6 and 7 can continue their oscillating movement without striking the glue roller or label stack. If the pallets 6 and 7, upon the next orbit or revolution are to pick up labels again because there is no gap in the bottle line, this condition is sensed and then shortly before the slider or valve switches 41 encounters the rollers the radially inwardly lying roller 26 moves downwardly in the path of rotation of the valve slider and presses the latter after which the roller 26 is immediately retracted out of the orbital path. Control valve 24 then applies pressure to the proper side of the carriage driver piston 17 in cylinder 15 for shifting the carriage sleeve 12 and, hence, the pallets 6 and 7 into the normal operating position where they are held by constant application of pressure on one side of the piston. If, on the other hand, during the next revolution or orbit no labels are to be removed from the stack 9, then no change in the valve takes place.

In FIG. 3, the neutral position of a glue pallet 7 is shown in full lines while the active position is shown in dash-dot lines. A relative position between the left hand edge area, the middle area and the right hand edge area of the backs of labels 9 and the glue pallet 7 are indicated as they are traversed during the rolling movement on the stack of labels. It should be recognized that the ends of the curved glue coated pallet surfaces do not extend radially beyond the maximum orbit indicated by the radius r though no contact with the glue roller 8 nor the label stack or stacks 9 is made by the pallets. As shown in FIG. 3, the shifting force is applied in the direction of the arrow along the radius, r, which, in this example lies in the plane of symmetry of the curved glue bearing surface of the pallet.

I claim:

1. A labeling machine for containers such as bottles comprising a rotor driven rotationally about an axis; at least one pallet device mounted on said rotor radially spaced from said axis; said device including a pallet having a curved glue receiving surface and movable in an orbital path as said rotor rotates and oscillatable for rolling sequentially onto a glue applicator and a label which are located adjacent said orbital path; and, an improved device for maintaining said pallet out of contact with said applicator and label when no container will be present at the station where the glue bearing label would be transferred to a container;

said device comprising:

shaft means having an axis parallel to the rotational axis of the rotor and means for oscillating said shaft means, carriage means on which said pallet is supported for presenting said curved glue receiving surface toward said glue applicator and label, and means for mounting said carriage means to said shaft means for shifting in a direction transverse to the axis of said shaft means between a neutral position wherein said pallet is retracted toward said rotor axis so the pallet cannot contact said glue applicator or label and an active position wherein said pallet is moved farther away from said rotor axis and can contact said applicator and label while the pallet oscillates, a drive member mounted in said shaft means and engageable with said carriage means, and means responding to the absence of a container at said station by actuating said drive member to drive said carriage to and hold it in neutral position and responding to the presence of a container at said station by actuating said drive member to drive said carriage to and hold it in active position.

2. The labeling machine according to claim 1 including stop means for stopping said carriage at predetermined limits corresponding to said neutral and said active pallet positions.

3. The labeling machine according to claim 1 including guide means on which said carriage moves relative to said shaft means, said guide means being constructed and arranged to guide said carriage means along a line parallel to the shortest line between the curved surface of said pallet and the axis of said shaft means.

4. The labeling machine according to claim 1 wherein there is more than one of said pallets supported on said carriage means for being moved simultaneously between positions corresponding to the neutral and active positions of said pallets by said drive member.

5. The labeling machine according to claim 1 wherein:

said drive member comprises piston means and there is a cylinder in said shaft means in which said piston means is movable transversely to the axis of said shaft means, said shaft means containing channels communicating with said cylinder on opposite sides of said piston means, valve means having a pressurized air inlet mounted to said rotor and coupled to said channels and operable to apply air pressure to one side of said piston means while allowing the other side of said piston means to exhaust, said means responding to the presence and absence of a container including valve operator means at a predetermined location along the orbital path of said shaft means, said operator means responding to the absence of a container by actuating said valve means to apply pressure to one side of the piston for driving said carriage and pallet thereon to neutral position and holding the carriage in neutral position and responding to the presence of a container by actuating said valve means to apply pressure to the other side of said piston for driving said carriage and pallet to active position and holding said carriage in active position.

6. The labeling machine according to claim 5 wherein said predetermined location of the valve operator means is between said label stack and a place at which the label is removed from the pallet.

7. A labeling machine for containers such as bottles comprising a rotor driven rotationally about an axis; at least one pallet device mounted on said rotor radially spaced from said axis; said device including a pallet having a curved glue receiving surface and movable in an orbital path as said rotor rotates and oscillatable for rolling sequentially onto a glue applicator and a label which are located adjacent said orbital path; and, an improved device for maintaining said pallet out of contact with said applicator and label when no container will be present at the station where the glue bearing label would be transferred to a container;

said device comprising:

shaft means having axes parallel to the rotational axis of the rotor, and means for oscillating the shaft means as they orbit with said rotor, carriage means mounted to each shaft means for rotating therewith and for shifting transversely to the axis thereof between a neutral position and an active position, and at least one glue pallet mounted on the carriage means, said shaft means containing a cylinder and a piston in said cylinder engageable with said carriage means, pressurizing one side of said piston causing it to shift said carriage means to neutral position and pressurizing the other side causing said piston to shift said carriage means to active position, said shaft means having air conducting channels communicating, respectively, with said cylinder on opposite sides of said piston, valve means having a pressurized air inlet and mounted to said rotor and coupled to said channels and operable to apply pressure to one side of said piston while allowing the other side to exhaust, valve operator means at a predetermined location along the orbital path of said shaft means, said operator means responding to the absence of a container at said station by actuating said valve means to pressurize said piston means for shifting said carriage means to neutral position and holding it in neutral position wherein said pallet cannot contact said glue applicator or said label stack while orbiting and oscillating, and responding to the presence of a container by actuating said valve means to pressurize said piston means for shifting said carriage means to active position and holding it in active position.

8. The labeling machine according to claim 7 wherein there is more than one pallet mounted to said carriage means.

* * * * *